US011455972B2

(12) United States Patent
Wu

(10) Patent No.: US 11,455,972 B2
(45) Date of Patent: Sep. 27, 2022

(54) DISPLAY DEVICE AND COLOR ADJUSTING METHOD

(71) Applicant: QISDA CORPORATION, Taoyuan (TW)

(72) Inventor: Chun-Chang Wu, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 20 days.

(21) Appl. No.: 17/218,195

(22) Filed: Mar. 31, 2021

(65) Prior Publication Data

US 2021/0312882 A1 Oct. 7, 2021

(30) Foreign Application Priority Data

Apr. 1, 2020 (TW) ..... 10911115.6

(51) Int. Cl.
*G09G 5/02* (2006.01)
*G09G 3/20* (2006.01)

(52) U.S. Cl.
CPC ..... *G09G 5/026* (2013.01); *G09G 3/2003* (2013.01); *G09G 2320/0666* (2013.01)

(58) Field of Classification Search
CPC ..... G09G 5/026
See application file for complete search history.

(56) References Cited

U.S. PATENT DOCUMENTS

2005/0062756 A1* 3/2005 Dyke ..... H04N 1/6077 345/604
2021/0056877 A1* 2/2021 Chew ..... F16M 11/2021

* cited by examiner

*Primary Examiner* — Gustavo Polo

(57) ABSTRACT

A display device includes a storage unit, a display unit and a processing unit. The storage unit stores a color parameter under a color space. The display unit displays an adjusting interface including a reference color block and a plurality of offset color blocks. When a target offset color block of the offset color blocks is selected, the processing unit updates a color coordinate of the reference color block by a color coordinate of the target offset color block and updates a color coordinate of each of the offset color blocks by a color coordinate of the updated reference color block and an offset value. The processing unit obtains a color transformation matrix according to the color coordinate of the reference color block, the color coordinate of the target offset color block and the color parameter. The processing unit adjusts three output percentages of RGB by the color transformation matrix.

20 Claims, 5 Drawing Sheets

16

| | | |
|---|---|---|
| C1<br>(x-d1-d2, y-d1+d2) | C2<br>(x-d1, y-d1+d2) | C3<br>(x-d1+d2, y-d1+d2) |
| C8<br>(x-d1-d2, y-d1) | C0<br>(x-d1, y-d1) | C4<br>(x-d1+d2, y-d1) |
| C7<br>(x-d1-d2, y-d1-d2) | C6<br>(x-d1, y-d1-d2) | C5<br>(x-d1+d2, y-d1-d2) |

FIG. 3

16

| | | |
|---|---|---|
| C1<br>(x-d1-d2-d3, y-d1-d2+d3) | C2<br>(x-d1-d2, y-d1-d2+d3) | C3<br>(x-d1-d2+d3, y-d1-d2+d3) |
| C8<br>(x-d1-d2-d3, y-d1-d2) | C0<br>(x-d1-d2, y-d1-d2) | C4<br>(x-d1-d2+d3, y-d1-d2) |
| C7<br>(x-d1-d2-d3, y-d1-d2-d3) | C6<br>(x-d1-d2, y-d1-d2-d3) | C5<br>(x-d1-d2+d3, y-d1-d2-d3) |

FIG. 4

DISPLAY DEVICE AND COLOR ADJUSTING METHOD

BACKGROUND OF THE INVENTION

1. Field of the Invention

The invention relates to a display device and a color adjusting method and, more particularly, to a display device and a color adjusting method allowing a user to adjust color in real-time.

2. Description of the Prior Art

A high definition display device has been widely used to obtain high resolution. The high definition display device requires high precision of color. At present, a colorimeter used for calibrating color of the display device usually uses CIE1931 coordinate system to measure chrominance of the display device. However, CIE1931 coordinate system is not suitable for performing comparison and calculation for color vision of human eyes. Therefore, metameric colors may still exist between different display devices even if color calibration has been performed for the display devices, such that a user needs to adjust color by himself/herself to obtain identical color output. In the prior art, the user adjusts color by adjusting gain and/or offset of RGB. However, the aforesaid adjusting manner will also affect brightness, color gamut and gamma of the display device and the operation thereof is inconvenient.

SUMMARY OF THE INVENTION

An objective of the invention is to provide a display device and a color adjusting method allowing a user to adjust color in real-time, so as to solve the aforesaid problems.

According to an embodiment of the invention, a display device includes a storage unit, a display unit and a processing unit. The storage unit stores a color parameter under a color space. The display unit displays an adjusting interface. The adjusting interface includes a reference color block and a plurality of offset color blocks. Color coordinates of the offset color blocks are determined by a color coordinate of the reference color block and an offset value sequence. The offset value sequence includes a plurality of offset values. The processing unit is coupled to the storage unit and the display unit. Therein, when one of the offset color blocks is selected as a target offset color block, the processing unit updates the color coordinate of the reference color block by the color coordinate of the target offset color block, and updates the color coordinate of each offset color block by the color coordinate of the updated reference color block and one of the offset values. The processing unit obtains a color transformation matrix according to the color coordinate of the reference color block, the color coordinate of the target offset color block, and the color parameter. The processing unit adjusts three output percentages of RGB by the color transformation matrix.

According to another embodiment of the invention, a color adjusting method is adapted to a display device. The color adjusting method includes steps of the display device storing a color parameter under a color space; the display device displaying an adjusting interface, wherein the adjusting interface includes a reference color block and a plurality of offset color blocks, color coordinates of the offset color blocks are determined by a color coordinate of the reference color block and an offset value sequence, and the offset value sequence includes a plurality of offset values; when one of the offset color blocks is selected as a target offset color block, the processing unit updating the color coordinate of the reference color block by the color coordinate of the target offset color block, and updating the color coordinate of each offset color block by the color coordinate of the updated reference color block and one of the offset values; the processing unit obtaining a color transformation matrix according to the color coordinate of the reference color block, the color coordinate of the target offset color block, and the color parameter; and the processing unit adjusting three output percentages of RGB by the color transformation matrix.

As mentioned in the above, when a user wants to adjust the current color of the display device, the user can select one of the offset color blocks as a target offset color block by the adjusting interface. When the target offset color block is selected, the color coordinate of the reference color block and the color coordinates of all offset color blocks will be updated. Therefore, the user can gradually adjust the current color of the display device to the target color according to the color changes of the reference color block and the offset color blocks. Furthermore, the display device according to the invention can automatically calculates the color transformation matrix according to the color coordinate of the reference color block, the color coordinate of the target offset color block, and the color parameter, and adjusts three output percentages of RGB by the color transformation matrix, so as to update the current color of the display device to be a new color adjusted by the user. Since the color transformation matrix does not need to be calculated by an external color analyzer, the invention is very convenient for common users.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 3 is a schematic diagram illustrating the adjusting interface in FIG. 2 after a target offset color block is selected.

FIG. 4 is a schematic diagram illustrating the adjusting interface in FIG. 3 after a target offset color block is selected.

DETAILED DESCRIPTION

Figure 1:
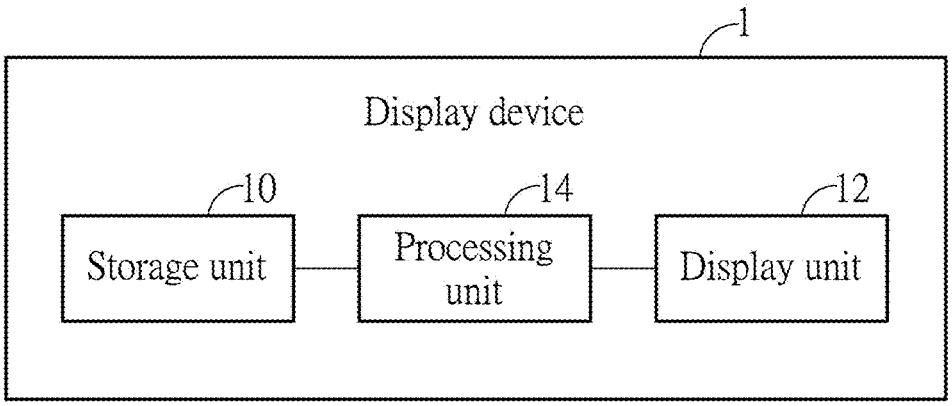
FIG. 1 is a functional block diagram illustrating a display device of an embodiment according to the invention.
Figure 2:
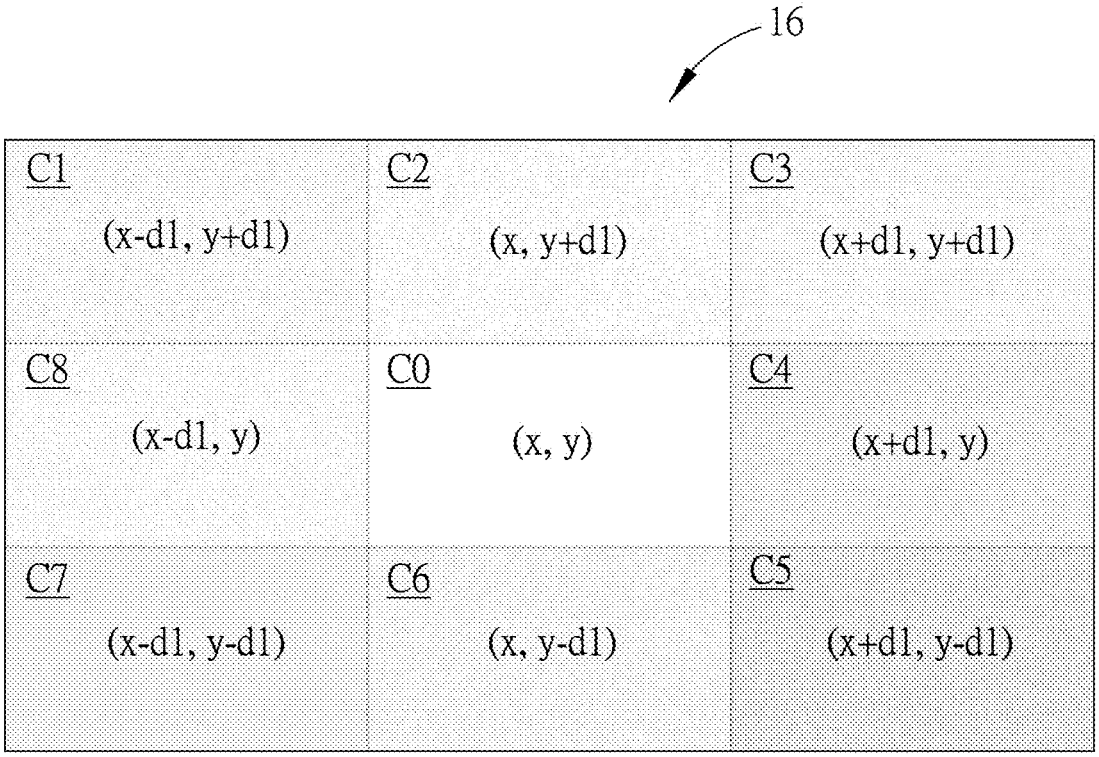
FIG. 2 is a schematic diagram illustrating an initial image of an adjusting interface of an embodiment according to the invention.

Please refer to FIG. 1 to FIG. 4. FIG. 1 is a functional block diagram illustrating a display device 1 of an embodiment according to the invention. FIG. 2 is a schematic diagram illustrating an initial image of an adjusting interface 16 of an embodiment according to the invention. FIG. 3 is a schematic diagram illustrating the adjusting interface 16 in FIG. 2 after a target offset color block C7 is selected. FIG. 4 is a schematic diagram illustrating the adjusting interface 16 in FIG. 3 after a target offset color block C7 is selected.

As shown in FIG. 1, the display device 1 comprises a storage unit 10, a display unit 12 and a processing unit 14; therein, the processing unit 14 is coupled to the storage unit 10 and the display unit 12. In practical applications, the storage unit 10 may be a memory or other data storage devices, the display unit 12 may be a display panel, and the processing unit 14 may be a processor or a controller with data processing function. In general, the display device 1 may be further equipped with some necessary hardware or software components for specific purposes, such as an input/output port, an application, a circuit board, a power supply, a communication module, etc., and it depends on practical applications.

The storage unit 10 stores a color parameter under a color space; therein, the color space has been processed by color calibration in advance. In this embodiment, the aforesaid color space can be a linear color space, i.e. a three-axis coordinate system capable of performing linear transformation for matrix, such as CIE1931XYZ, CIE1931RGB, CIE2015XYZ, LMS color space, or other color spaces using three characteristic vectors $\{\bar{x}(\lambda), \bar{y}(\lambda), \bar{z}(\lambda)\}$ to depict spectrum $I(\lambda)$. Since the aforesaid color space has been processed by color calibration in advance, the aforesaid color space conforms to standard color gamut defined by international organizations, such as sRGB, AdobeRGB, DCI-P3, BT.709, BT.2020, NTSC, Apple RGB, CIE1931RGB etc. and a color temperature of white conforms to a standard of D50, D55, D65, D75, D93, E, DCI-P3, 3000K-10000K of black body radiation curve, etc. Accordingly, color performance of WRGB can be represented by an RGB tristimulus matrix $$\begin{pmatrix} R_X & R_Y & R_Z \\ G_X & G_Y & G_Z \\ B_X & B_Y & B_Z \end{pmatrix},$$

wherein X, Y or Z represents a component of a coordinate axis in the aforesaid color space.

In an embodiment, the aforesaid color parameter can be color coordinates of WRGB, wherein W represents white, R represents red, G represents green, and B represents blue. At this time, the processing unit 14 can obtain an RGB tristimulus matrix according to the color coordinates of WRGB.

According to an embodiment, the data of color coordinates (x, y, z) of WRGB can be shown in table 1 below. In this embodiment, the storage unit 10 can store the color coordinates (x, y) of WRGB shown in table 1 below and the color coordinate z can be calculated and obtained by 1-x-y. As mentioned in the above, the color coordinates (x, y, z) of WRGB shown in table 1 have been processed by color calibration in advance.

TABLE 1

| | Color coordinate | | |
|---|---|---|---|
| | x | y | z |
| W | 0.3127 | 0.329 | 0.3583 |
| R | 0.64 | 0.33 | 0.03 |

TABLE 1-continued

| | Color coordinate | | |
|---|---|---|---|
| | x | y | z |
| G | 0.3 | 0.6 | 0.1 |
| B | 0.15 | 0.06 | 0.79 |

The color coordinates (x, y, z) of RGB shown in table 1 can be represented by an RGB color gamut matrix $$\begin{pmatrix} R_x & R_y & R_z \\ G_x & G_y & G_z \\ B_x & B_y & B_z \end{pmatrix}.$$

Then, the RGB color gamut matrix $$\begin{pmatrix} R_x & R_y & R_z \\ G_x & G_y & G_z \\ B_x & B_y & B_z \end{pmatrix}$$

can be transformed into an RGB color gamut inverse matrix $$\begin{pmatrix} R_x & R_y & R_z \\ G_x & G_y & G_z \\ B_x & B_y & B_z \end{pmatrix}^{-1},$$

According to the data of table 1, $$\begin{pmatrix} R_x & R_y & R_z \\ G_x & G_y & G_z \\ B_x & B_y & B_z \end{pmatrix}^{-1} \text{ is } \begin{pmatrix} 2.088353 & -1.15529 & 0.066934 \\ -0.99063 & 2.236055 & -0.24543 \\ -0.32129 & 0.049531 & 1.271754 \end{pmatrix}.$$

Furthermore, the color coordinate $(x\ y\ z)_W$ of W can be normalized by the color coordinate y of W to be $$\left(\frac{x}{y}\ \ 1\ \ \frac{z}{y}\right)_W,$$

wherein $$\left(\frac{x}{y}\ \ 1\ \ \frac{z}{y}\right)_W = (0.950456\ \ 1\ \ 1.089058).$$

Then, a composition coefficient $(r_W\ g_W\ b_W)$ of the color coordinate of W can be obtained by an equation 1 below, wherein $(r_W\ g_W\ b_W)$ is obtained by the normalized color coordinate $$\left(\frac{x}{y}\ \ 1\ \ \frac{z}{y}\right)_W$$

of W and the RGB color gamut inverse matrix $$\begin{pmatrix} R_x & R_y & R_z \\ G_x & G_y & G_z \\ B_x & B_y & B_z \end{pmatrix}^{-1},$$

$$(r_W \quad g_W \quad b_W) = \left(\frac{x}{y} \quad 1 \quad \frac{z}{y}\right)_W * \begin{pmatrix} R_X & R_Y & R_Z \\ G_X & G_Y & G_Z \\ B_X & B_Y & B_Z \end{pmatrix} \qquad \text{Equation 1}$$

According to the equation 1, the composition coefficient ($r_W$ $g_W$ $b_W$) of the color coordinate of W is (0.644361 1.191948 1.203205).

Then, the RGB tristimulus matrix $$\begin{pmatrix} R_X & R_Y & R_Z \\ G_X & G_Y & G_Z \\ B_X & B_Y & B_Z \end{pmatrix}$$

can be obtained by an equation 2 below.

$$\begin{pmatrix} R_X & R_Y & R_Z \\ G_X & G_Y & G_Z \\ B_X & B_Y & B_Z \end{pmatrix} = \begin{pmatrix} r_W R_x & r_W R_y & r_W R_z \\ g_W G_x & g_W G_y & g_W G_z \\ b_W B_x & b_W B_y & b_W B_z \end{pmatrix}. \qquad \text{Equation 2}$$

According to the equation 2, the data of the RGB tristimulus matrix $$\begin{pmatrix} R_X & R_Y & R_Z \\ G_X & G_Y & G_Z \\ B_X & B_Y & B_Z \end{pmatrix}$$

can be shown in table 2 below.

TABLE 2

| | X | Y | Z |
|---|---|---|---|
| R | 0.4124 | 0.2126 | 0.0193 |
| G | 0.3576 | 0.7152 | 0.1192 |
| B | 0.1805 | 0.0722 | 0.9505 |

In another embodiment, the aforesaid color parameter can also be the RGB tristimulus matrix. In other words, the invention can calculate the RGB tristimulus matrix in advance according to the aforesaid manner and then store the RGB tristimulus matrix in the storage unit 10.

In the embodiment, the display device 1 can provide a button (not shown in the figures) for triggering the color adjustment function. When the user wants to adjust the current color of the display device 1, the user can press the button. At this time, the display unit 12 will display an adjusting interface 16, as shown by FIG. 2. The adjusting interface 16 includes a reference color block C0 and a plurality of offset color blocks C1~C8. In the embodiment, the plurality of offset color blocks C1~C8 surround the reference color block C0 and are arranged in a square; however, it is not limited thereto. In another embodiment, the reference color block C0 can be located at any position relative to the offset color blocks C1~C8. Furthermore, the reference color block C0 and the offset color blocks C1~C8 also can be arranged in a line, a circle, an ellipse or other shapes, depending on actual applications. In the embodiment, the reference color block C0 and the offset color blocks C1~C8 are squares; however, it is not limited thereto. In another embodiment, the reference color block C0 and the offset color blocks C1~C8 can be a circle, an ellipse, a polygon or other shapes, depending on actual applications. It should be noted that the number of the offset color blocks can be determined according to actual applications, and is not limited to the embodiment shown by the figures.

The color coordinate of each of the offset color blocks C1~C8 is determined by a color coordinate of the reference color block C0 and an offset value sequence. The offset value sequence includes a plurality of offset values. For example, the offset value sequence can include the three offset value d1, d2 and d3 shown in FIG. 2 to FIG. 4. It should be noted that the number of the offset values can be determined according to actual applications, and is not limited to the embodiment shown in the figures. As shown by FIG. 2, the color coordinate of the reference color block C0 is (x, y), and the color coordinate of each of the offset color blocks C1~C8 is determined by the color coordinate (x, y) of the reference color block C0 and the offset value d1. Therein, the color coordinate of the offset color block C1 is (x−d1, y+d1), the color coordinate of the offset color block C2 is (x, y+d1), the color coordinate of the offset color block C3 is (x+d1, y+d1), and soon. As shown by FIG. 3, the color coordinate of the reference color block C0 is (x−d1,y−d1), and the color coordinate of each of the offset color blocks C1~C8 is determined by the color coordinate (x−d1, y−d1) of the reference color block C0 and the offset value d2. Therein, the color coordinate of the offset color block C1 is (x−d1-d2, y−d1+d2), the color coordinate of the offset color block C2 is (x−d1, y−d1+d2), the color coordinate of the offset color block C3 is (x−d1+d2, y−d1+d2), and so on. As shown by FIG. 4, the color coordinate of the reference color block C0 is (x−d1−d2, y−d1−d2), and the color coordinate of each of the offset color blocks C1~C8 is determined by the color coordinate (x−d1, y−d1) of the reference color block C0 and the offset value d3. Therein, the color coordinate of the offset color block C1 is (x−d1−d2−d3, y−d1−d2+d3), the color coordinate of the offset color block C2 is (x−d1−d2, y−d1−d2+d3), the color coordinate of the offset color block C3 is (x−d1−d2+d3, y−d1−d2+d3), and so on.

In the embodiment, the processing unit 14 can obtain RGB grayscale values of each of the offset color blocks C1~C8 according to the color coordinate of each of the offset color blocks C1~C8, the RGB tristimulus matrix, and a gamma value of the color space (having been processed by color calibration in advance). The following is an explanation with the offset color block C5 in FIG. 2. In the embodiment, the reference color block C0 can be any color block in the color space (e.g. white color block or other color blocks). A transformation coordinate of the reference color block C0 can be obtained by an equation 3 below.

$$(X \ Y \ Z)_{Reference} = (r \ g \ b)_{Refernce} * \begin{pmatrix} R_X & R_Y & R_Z \\ G_X & G_Y & G_Z \\ B_X & B_Y & B_Z \end{pmatrix}. \qquad \text{Equation 3}$$

In the equation 3, $(X\ Y\ Z)_{Reference}$ represents the transformation coordinate of the reference color block C0, $(X\ Y\ Z)_{Reference}$ represents three output percentages of RGB of the reference color block C0, and $$\begin{pmatrix} R_X & R_Y & R_Z \\ G_X & G_Y & G_Z \\ B_X & B_Y & B_Z \end{pmatrix}$$

represents the RGB tristimulus matrix.

It is assumed that the output percentages $(r\ g\ b)_{Reference}$ of RGB of the reference color block C0 is (1 1 1); that is, the reference color block C0 is the white color block. According to the equation 3, the transformation coordinate $(X\ Y\ Z)_{Reference}$ of the reference color block C0 is (0.950456 1 1.089058). Then, the color coordinate (x, y) of the reference color block C0 can be obtained by an equation 4 below. According to the equation 4, the color coordinate (x, y) of the reference color block C0 is (0.3127, 0.329).

$$\begin{cases} x = \dfrac{X}{(X+Y+Z)} \\ y = \dfrac{Y}{(X+Y+Z)} \\ z = \dfrac{Z}{(X+Y+Z)} = 1 - x - y \end{cases} \Rightarrow \begin{cases} X = Y\left(\dfrac{x}{y}\right) \\ Z = Y\left(\dfrac{z}{y}\right) \end{cases}. \qquad \text{Equation 4}$$

It is assumed that the offset value d1 is 0.01 and then the color coordinate of the offset color block C5 is (0.3227, 0.319), in which the brightness is not adjusted. Since Y represents brightness and is not adjusted, the Y value of the transformation coordinate $(X\ Y\ Z)_{Offset}$ of the offset color block C5 is equal to the Y value of the transformation coordinate $(X\ Y\ Z)_{Reference}$ of the offset color block C0. According to the equation 4, the transformation coordinate $(X\ Y\ Z)_{Offset}$ of the offset color block C5 is (1.011599 1 1.123197).

Then, the output percentages of RGB $(r\ g\ b)_{Offset}$ by the color offset color block C5 can be obtained by an equation 5 below.

$$(r\ \ g\ \ b)_{Offset} = (X\ \ Y\ \ Z)_{Offset} * \begin{pmatrix} R_X & R_Y & R_Z \\ G_X & G_Y & G_Z \\ B_X & B_Y & B_Z \end{pmatrix}^{-1}. \qquad \text{Equation 5}$$

According to the equation 5, the output percentages of RGB $(r\ g\ b)_{Offset}$ by the color offset color block C5 is (1.18114 0.942156 1.039486). It should be noted that the output percentage of RGB is between 0 and 1. Therefore, $(r\ g\ b)_{Offset}$ can be divided by the maximum of the $(r\ g\ b)_{Offset}$, so that (1.18114 0.942156 1.039486) is transformed into (1 0.797667 0.88007).

Then, grayscale percentages of RGB of the offset color block C5 can be calculated by an equation 6 below.

$$V = L^{1/\gamma}. \qquad \text{Equation 6}$$

In the equation 6, V represents grayscale percentages of RGB, L represents output percentages of RGB, and γ represents a gamma value.

It is assumed that the gamma value γ is 2.2. Therefore, according to the equation 6, the grayscale percentages of RGB of the offset color block C5 are (1 0.902347 0.943584). Then, the RGB grayscale values of the offset color block C5 will be (255 230 241), which is obtained by multiplying the grayscale percentages of RGB of the offset color block C5 by 255. In the embodiment, the RGB grayscale values of each of the offset color blocks C1~C8 can be obtained by the same way, for displaying the colors of the offset color blocks C1~C8 in the adjusting interface 16 correspondingly. Therefore, when the reference color block C0 and the reference color blocks C1~C8 are updated, the colors of reference color block C0 and the reference color blocks C1~C8 are updated correspondingly.

When the user wants to adjust the current color of the display device 1, the initial image of the adjusting interface 16 is shown as FIG. 2. Then, the user can select one of the offset color blocks C1~C8 as a target offset color block according to a target color; therein, the color of the target offset color block is closer to the target color. In the embodiment, the target color can be provided by another display device or a color sheet. If the target color is provided by a color sheet, the color sheet can be illuminated by standard light sources (D65, D50 etc.) or common light sources, depending on actual applications.

When the target offset color block is selected, the processing unit 14 will update the color coordinate of the reference color block C0 by the color coordinate of the target offset color block, and update the color coordinate of each of the offset color blocks C1~C8 by the color coordinate of the updated reference color block and one of the offset values. For example, the user can select the offset color block C7 in FIG. 2 as the target offset color block. At this time, the processing unit 14 updates the color coordinate of the reference color block C0 by the color coordinate (x−d1, y−d1) of the target offset color block C7, and updates the color coordinate of each of the offset color blocks C1~C8 by the color coordinate (x−d1, y−d1) of the updated reference color block C0 and the offset value d2, as shown by FIG. 3. When the user selects the offset color block C7 in FIG. 3 as the target offset color block again, the processing unit 14 updates the color coordinate of the reference color block C0 by the color coordinate (x−d1−d2, y−d1−d2) of the target offset color block C7, and updates the color coordinate of each of the offset color blocks C1~C8 by the color coordinate (x−d1−d2, y−d1−d2) of the updated reference color block C0 and the offset value d3, as shown by FIG. 4.

In the embodiment, the offset value used to update the color coordinate of each of the offset color blocks C1~C8 each time can be gradually decreased, i.e. d1>d2>d3. Therefore, after the target offset color block is selected multiple times, the reference color block C0 approaches the target color. In actual applications, the offset value can be gradually decreased in a predetermined way; therein, the predetermined way can be an arithmetic sequence, a geometric sequence, or other decreasing ways. In another embodiment, the offset value used to update the color coordinate of each of the offset color blocks C1~C8 each time can be set by the user. In other words, the user can set the magnitude and quantity of the offset values by himself/herself, so that the reference color block C0 approaches the target color.

In the embodiment, after the target offset color block is selected, the processing unit 14 can obtain the color transformation matrix according to the color coordinate of the reference color block, the color coordinate of the target offset color block, and the color parameter. For example, the processing unit 14 can calculate the color transformation matrix every time the target offset color block is selected. Furthermore, after the offset color block C7 in FIG. 2 is selected, the processing unit 14 calculates the color transformation matrix according to the color coordinate (x, y) of the reference color block C0 and the color coordinate (x−d1, y−d1) of the target offset color block C7; after the offset color block C7 in FIG. 3 is selected, the processing unit 14 calculates the color transformation matrix according to the color coordinate (x−d1, y−d1) of the reference color block C0 and the color coordinate (x−d1−d2, y−d1−d2) of the target offset color block C7; and after the offset color block C7 in FIG. 4 is selected, the processing unit 14 calculates the color transformation matrix according to the color coordinate (x−d1-d2, y−d1−d2) of the reference color block C0 and the color coordinate (x−d1−d2−d3, y−d1−d2−d3) of the target offset color block C7. After the color transformation matrix is obtained, the processing unit 14 adjusts three output percentages of RGB by the color transformation matrix, so as to update the current color to a new color adjusted by the user.

As discussed above, in an embodiment, the color parameter can be the color coordinates of WRGB, and the processing unit 14 can obtain the RGB tristimulus matrix according to the color coordinates of WRGB. Furthermore, in another embodiment, the color parameter can be the RGB tristimulus matrix. Therefore, the processing unit 14 can obtain the color transformation matrix according to the color coordinate of the reference color block, the color coordinate of the target offset color block, and the RGB tristimulus matrix.

In the embodiment, the color transformation matrix can be obtained by equations 7 to 9 below.

$$(X\ \ Y\ \ Z)_{Offset} = (X\ \ Y\ \ Z)_{Reference} * M_T. \qquad \text{Equation 7}$$

$$M_T = \begin{pmatrix} \frac{X_{Offset}}{X_{Reference}} & 0 & 0 \\ 0 & \frac{Y_{Offset}}{Y_{Reference}} & 0 \\ 0 & 0 & \frac{Z_{Offset}}{Z_{Reference}} \end{pmatrix}. \qquad \text{Equation 8}$$

$$M_C = \begin{pmatrix} R_X & R_Y & R_Z \\ G_X & G_Y & G_Z \\ B_X & B_Y & B_Z \end{pmatrix} * M_T * \begin{pmatrix} R_X & R_Y & R_Z \\ G_X & G_Y & G_Z \\ B_X & B_Y & B_Z \end{pmatrix}^{-1}. \qquad \text{Equation 9}$$

In the equations 7 to 9, $(X\ Y\ Z)_{Reference}$ represents the transformation coordinate of the reference color block, $(X\ Y\ Z)_{Offset}$ represents the shift coordinate of the target offset color block, $M_T$ represents a coordinate transformation matrix, $$\begin{pmatrix} R_X & R_Y & R_Z \\ G_X & G_Y & G_Z \\ B_X & B_Y & B_Z \end{pmatrix}$$

represents the RGB tristimulus matrix, and $M_C$ represents the color transformation matrix.

Furthermore, by the equation 4, the processing unit 14 can obtain the transformation coordinate of the reference color block according to the color coordinate of the reference color block, and obtain the transformation coordinate of the target offset color block according to the color coordinate of the target offset color block. It is assumed that the color coordinate of the reference color block is (0.3127 0.329). Then, according to the equation 4, the transformation coordinate of the reference color block C0 is (0.9505 1 1.0891). Furthermore, it is assumed that the color coordinate of the target offset color block C7 is (0.3027 0.319), in which the brightness is not adjusted. According to the equation 4, the transformation coordinate of the target offset color block is (0.9489 1 11859).

According to the equations 7 and 8, the coordinate transformation matrix $M_T$ is $$\begin{pmatrix} 0.9984 & 0 & 0 \\ 0 & 1 & 0 \\ 0 & 0 & 10889 \end{pmatrix}.$$

Then, according to the equation 9, the color transformation matrix $M_C$ is $$\begin{pmatrix} 0.9970 & 0.0007 & 0.0018 \\ -0.0072 & 1.0010 & 0.0112 \\ -0.0431 & 0.0038 & 1.0893 \end{pmatrix}.$$

Then, the processing unit 14 can adjust three output percentages of RGB by the color transformation matrix $M_C$ according to an equation 10 below, so as to update the current color to be a new color adjusted by the user in real-time.

$$(r\ g\ b)_{Adjusted} = (r\ g\ b)_{Original} * M_C. \qquad \text{Equation 10}$$

In the equation 10, $(r\ g\ b)_{Original}$ represents the output percentages of RGB before adjusted by the color transformation matrix $M_C$, and $(r\ g\ b)_{Adjusted}$ represents the output percentages of RGB after adjusted by the color transformation matrix $M_C$. When $(r\ g\ b)_{Original}$ is (1 1 1), $(r\ g\ b)_{Adjusted}$ is (0.9467 1.0055 1.1023).

Figure 5:
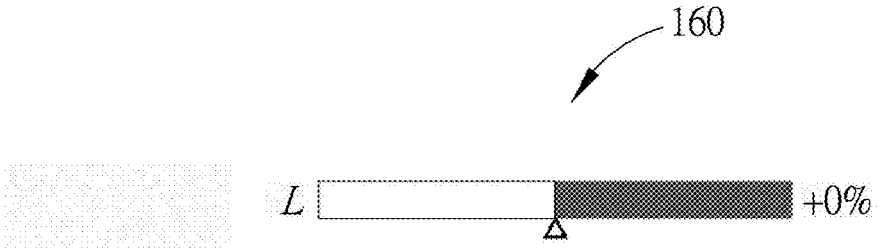
FIG. 5 is a schematic diagram illustrating a brightness adjusting template of an embodiment according to the invention.

Please refer to FIG. 5. FIG. 5 is a schematic diagram illustrating a brightness adjusting template 160 of an embodiment according to the invention. In another embodiment, the adjusting interface 16 according to the invention may include the brightness adjusting template 160 shown by FIG. 5. Therefore, in addition to using the adjustment interface 16 in FIG. 2 to FIG. 4 to adjust the color, the user can also use the brightness adjustment template 160 in FIG. 5 to adjust the brightness.

It is assumed that the color coordinate of the reference color block is (0.3127 0329), the color coordinate of the target offset color block is (0.3027 0319), and the brightness is adjusted to 95% through the brightness adjusting template 160. Since Y represents brightness and the brightness is adjusted to 95%, the Y value of the transformation coordinate of the target offset color block is equal to the Y value of the transformation coordinate of the reference color block multiplied by 95%. According to the equation 4, the transformation coordinate of the target offset color block is (0.9015 0.95 1.1266).

According to the equations 7 and 8, the coordinate transformation matrix $M_T$ is $$\begin{pmatrix} 0.9484 & 0 & 0 \\ 0 & 0.95 & 0 \\ 0 & 0 & 1.0345 \end{pmatrix}.$$

Then, according to the equation 9, the color transformation matrix $M_C$ is $$\begin{pmatrix} 0.9471 & 0.0007 & 0.0017 \\ -0.0068 & 0.9510 & 0.0106 \\ -0.0409 & 0.0036 & 1.0349 \end{pmatrix}.$$

Then, the processing unit 14 can adjust the three output percentages of RGB by the color transformation matrix $M_C$ according to the equation 10, so as to update the current color to be a new color adjusted by the user in real-time. When $(r\ g\ b)_{Original}$ is (1 1 1), $(r\ g\ b)_{Adjusted}$ is (0.8993 0.9553 1.0472).

It should be noted that the above color space will first generate an original color transformation matrix after color calibration. After obtaining the adjusted output percentages $(r\ g\ b)_{Adjusted}$ of RGB according to the above method, the present invention will multiply $(r\ g\ b)_{Adjusted}$ by the original color transformation matrix to obtain the updated output percentages $(r\ g\ b)_{Updated}$ of RGB based on the un-calibrated color space. If $(r\ g\ b)_{Updated}$ contains a value greater than 1, the invention will divide the $(r\ g\ b)_{Updated}$ by the maximum in $(r\ g\ b)_{Updated}$, so that $(r\ g\ b)_{Updated}$ is between 0 and 1. Then, the current color is updated to be a new color adjusted by the user according to a conventional color conversion method.

In another embodiment, after the target offset color block is selected multiple times, the processing unit 14 obtains the color transformation matrix according to the initial color coordinate of the reference color block, the color coordinate of the target offset color block selected last time, and the color parameter. For example, the user can select the target offset color block C7 in FIG. 2 to FIG. 4 in turn; that is, the target offset color block C7 is selected three times. At this time, the initial color coordinate of the reference color block C0 is (x, y) in FIG. 2, and the color coordinate of the target offset color block C7 selected last time is (x−d1−d2−d3, y−d1−d2−d3) in FIG. 4. Then, the user may click a confirm button (not shown in the figures). Then, the processing unit 14 will calculate the color transformation matrix according to the initial color coordinate (x, y) of the reference color block and the color coordinate (x−d1−d2−d3, y−d1−d2−d3) of the target offset color block C7. It should be noted that the calculation and application of the color transformation matrix are as described above, and will not be repeated herein.

Figure 6:
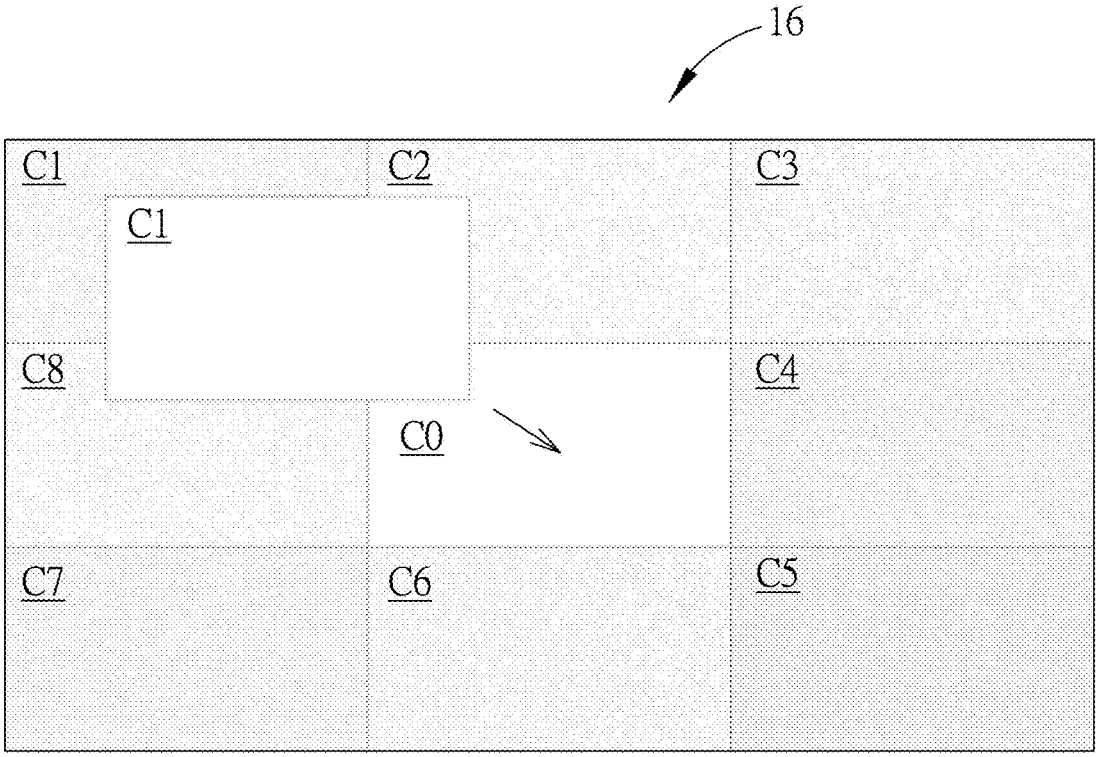
FIG. 6 is a schematic diagram illustrating the adjusting interface when a target offset color block is being selected.

Please refer to FIG. 6. FIG. 6 is a schematic diagram illustrating the adjusting interface 16 when the target offset color block C1 is being selected. As shown by FIG. 6, when the target offset color block (e.g. the offset color block C1) is selected, the processing unit 14 dynamically moves the target offset color block to the reference color block C0. Thereby, the user can clearly know which color block is selected as the target offset color block.

Figure 7:
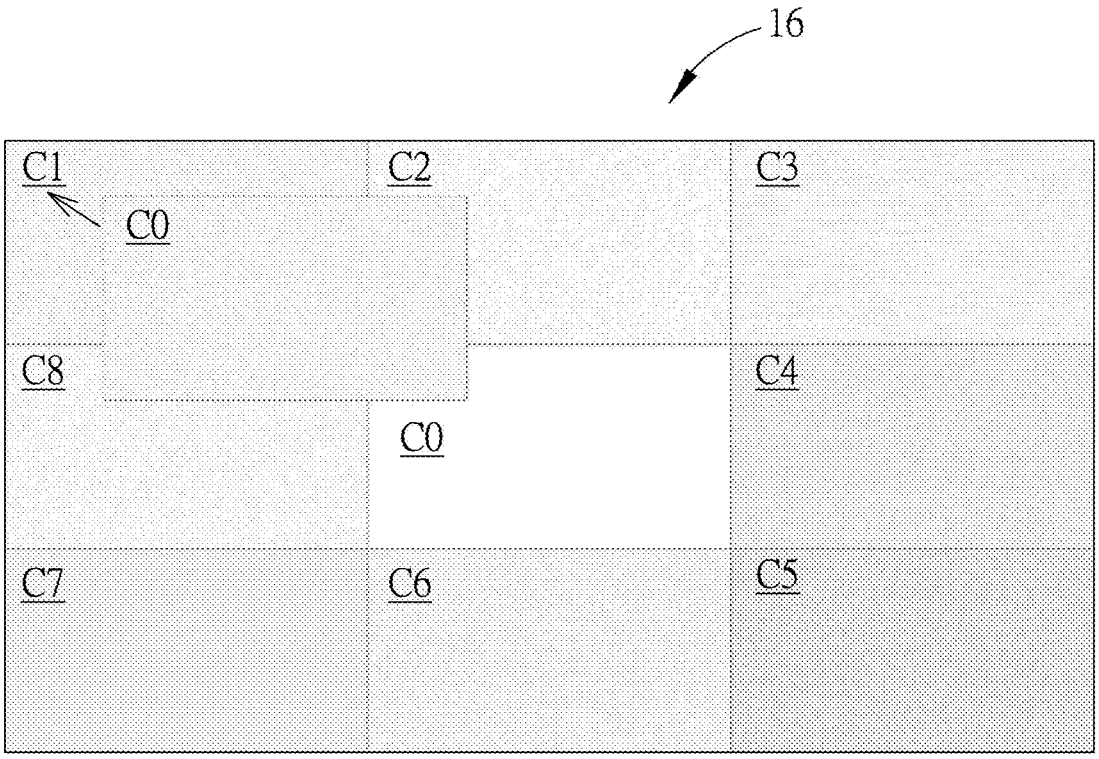
FIG. 7 is a schematic diagram illustrating the adjusting interface when the reference color after updated is being restored.

Please refer to FIG. 7. FIG. 7 is a schematic diagram illustrating the adjusting interface 16 when the reference color C0 after updated is being restored. In another embodiment, after the target offset color block is selected, the invention allows the user to restore the updated reference color block to the previous state, so as to re-select the target offset color block. As shown by FIG. 7, when the reference color block C0 after updated is to be restored, the processing unit 14 can dynamically move the updated reference color block C0 back to the target offset color block (e.g. the offset color block C1). Thereby, the user can clearly know which color block was selected as the target offset color block last time.

Figure 8:
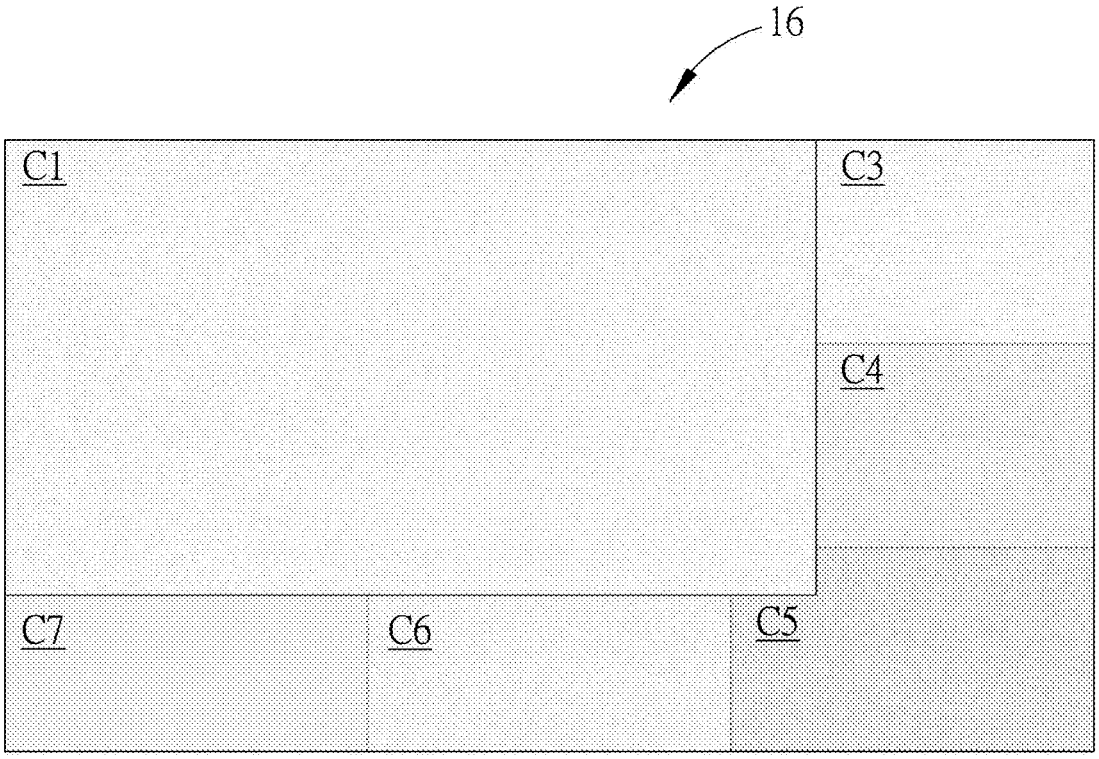
FIG. 8 is a schematic diagram illustrating the adjusting interface when the target offset color block is enlarged.

Please refer to FIG. 8. FIG. 8 is a schematic diagram illustrating the adjusting interface 16 when the target offset color block is enlarged. As shown by FIG. 8, when the target offset color block (e.g. the offset color block C1) is selected, the processing unit 14 can enlarge the target offset color block. Thereby, the user can clearly view the color of the selected target offset color block. In actual applications, the target offset color block can be enlarged to full screen or any size.

Figure 9:
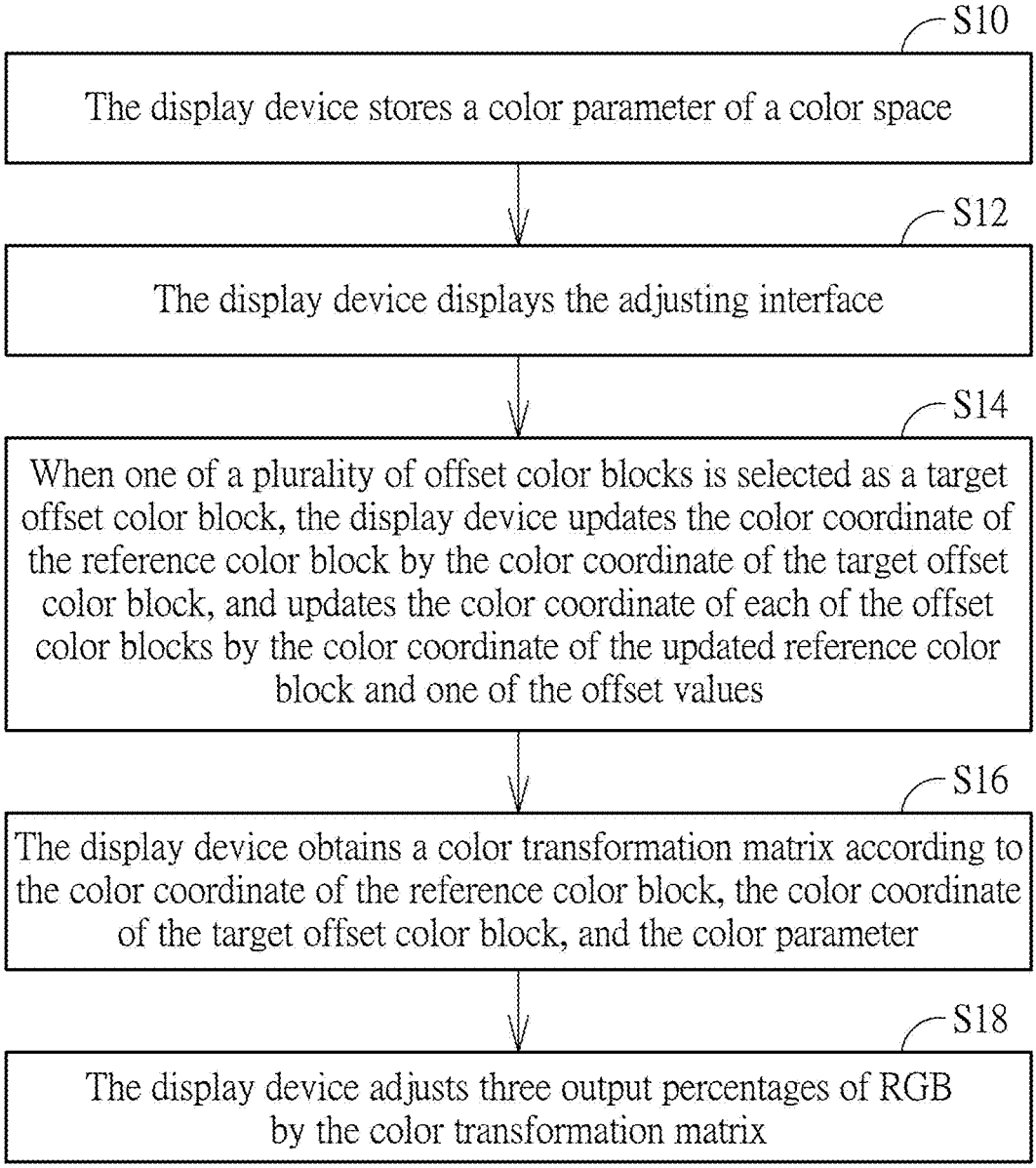
FIG. 9 is a flowchart of a color adjusting method of an embodiment according to the invention.

Please refer to FIG. 9. FIG. 9 is a flowchart of a color adjusting method of an embodiment according to the invention. The color adjusting method in FIG. 9 is applied to the display device 1 in FIG. 1. First, in the step S10, the display device 1 stores a color parameter of a color space; therein, the color space has been processed by color calibration in advance. Then, in the step S12, the display device 1 displays the adjusting interface 16. Then, in the step S14, when one of a plurality of offset color blocks C1~C8 is selected as a target offset color block, the display device 1 updates the color coordinate of the reference color block C0 by the color coordinate of the target offset color block, and updates the color coordinate of each of the offset color blocks C1~C8 by the color coordinate of the updated reference color block and one of the offset values. Then, in the step S16, the display device 1 obtains a color transformation matrix according to the color coordinate of the reference color block C0, the color coordinate of the target offset color block, and the color parameter. Then, in the step S18, the display device 1 adjusts three output percentages of RGB by the color transformation matrix.

It should be noted that the detailed embodiments of the color adjusting method according to the invention are mentioned in the above and those will not be depicted herein again. Furthermore, each part or function of the control logic of the color adjusting method according to the invention may be implemented by software, hardware or the combination thereof.

As mentioned in the above, when the user wants to adjust the current color of the display device, the user select one of the plurality of offset color blocks as a target offset color block. When the target offset color block is selected, the color coordinate of the reference color block and the color coordinates of all offset color blocks will be updated. Therefore, the user can gradually adjust the current color of the display device to the target color according to the color changes of the reference color block and the offset color blocks. Furthermore, the display device according to the invention can automatically calculates the color transformation matrix according to the color coordinate of the reference color block, the color coordinate of the target offset color block, and the color parameter, and adjusts three output percentages of RGB by the color transformation matrix, so as to update the current color of the display device to be a new color adjusted by the user. Since the color transformation matrix does not need to be calculated by an external color analyzer, the invention is very convenient for common users.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device, comprising:

a storage unit, storing a color parameter under a color space;

a display unit, displaying an adjusting interface, the adjusting interface comprising a reference color block and a plurality of offset color blocks, color coordinates of the offset color blocks being determined by a color coordinate of the reference color block and an offset value sequence, the offset value sequence comprising a plurality of offset values; and a processing unit, coupled to the storage unit and the display unit;

wherein when one of the offset color blocks is selected as a target offset color block, the processing unit updates the color coordinate of the reference color block by the color coordinate of the target offset color block, and updates the color coordinate of each of the offset color blocks by the color coordinate of the updated reference color block and one of the offset values, the processing unit obtains a color transformation matrix according to the color coordinate of the reference color block, the color coordinate of the target offset color block, and the color parameter, and the processing unit adjusts three output percentages of RGB by the color transformation matrix.

2. The display device according to claim 1, wherein the target offset color block is selected multiple times so that the reference color block approaches a target color, and the offset value used to update the color coordinate of each offset color block gradually decreases each time.

3. The display device according to claim 2, wherein the target color is provided by another display device or a color sheet.

4. The display device according to claim 1, wherein the offset value used to update the color coordinate of each offset color block is allowed to be set by a user.

5. The display device according to claim 1, wherein the plurality of offset color blocks surround the reference color block.

6. The display device according to claim 1, wherein when the target offset color block is selected, the processing unit dynamically moves the target offset color block to the reference color block.

7. The display device according to claim 1, wherein when the reference color block after updated is to be restored, the processing unit dynamically moves the updated reference color block back to the target offset color block.

8. The display device according to claim 1, wherein when the target offset color block is selected, the processing unit enlarges the target offset color block.

9. The display device according to claim 1, wherein after the target offset color block is selected multiple times, the processing unit obtains the color transformation matrix according to the initial color coordinate of the reference color block, the color coordinate of the target offset color block selected last time, and the color parameter.

10. The display device according to claim 1, wherein the color parameter is color coordinates of WRGB, the processing unit obtains an RGB tristimulus matrix according to the color coordinates of WRGB, and the processing unit obtains the color transformation matrix according to the color coordinate of the reference color block, the color coordinate of the target offset color block and the RGB tristimulus matrix.

11. The display device according to claim 10, wherein the processing unit obtains a transformation coordinate of the reference color block according to the color coordinate of the reference color block, and obtains a transformation coordinate of the target offset color block according to the color coordinate of the target offset color block, and the color transformation matrix is obtained by the following equations of:

$$(X\ \ Y\ \ Z)_{Offset} = (X\ \ Y\ \ Z)_{Reference} * M_T.;$$

$$M_T = \begin{pmatrix} \frac{X_{Offset}}{X_{Reference}} & 0 & 0 \\ 0 & \frac{Y_{Offset}}{Y_{Reference}} & 0 \\ 0 & 0 & \frac{Z_{Offset}}{Z_{Reference}} \end{pmatrix}; \text{and}$$

$$M_C = \begin{pmatrix} R_X & R_Y & R_Z \\ G_X & G_Y & G_Z \\ B_X & B_Y & B_Z \end{pmatrix} * M_T * \begin{pmatrix} R_X & R_Y & R_Z \\ G_X & G_Y & G_Z \\ B_X & B_Y & B_Z \end{pmatrix}^{-1};$$

wherein $(X\ Y\ Z)_{Reference}$ represents the transformation coordinate of the reference color block, $(X\ Y\ Z)_{Offset}$ represents the transformation coordinate of the target offset color block, $M_T$ represents a coordinate transformation matrix, $$\begin{pmatrix} R_X & R_Y & R_Z \\ G_X & G_Y & G_Z \\ B_X & B_Y & B_Z \end{pmatrix}$$

represents the RGB tristimulus matrix, and $M_C$ represents the color transformation matrix.

12. The display device according to claim 10, wherein the processing unit obtains RGB grayscale values of each offset color block according to the color coordinate of said offset color block, the RGB tristimulus matrix, and a gamma value of the color space.

13. The display device according to claim 1, wherein the color parameter is an RGB tristimulus matrix, and the processing unit obtains the color transformation matrix according to the color coordinate of the reference color block, the color coordinate of the target offset color block and the RGB tristimulus matrix.

14. The display device according to claim 13, wherein the processing unit obtains a transformation coordinate of the reference color block according to the color coordinate of the reference color block, and obtains a transformation coordinate of the target offset color block according to the color coordinate of the target offset color block, and the color transformation matrix is obtained by the following equations of:

$$(X\ \ Y\ \ Z)_{Offset} = (X\ \ Y\ \ Z)_{Reference} * M_T.;$$

$$M_T = \begin{pmatrix} \frac{X_{Offset}}{X_{Reference}} & 0 & 0 \\ 0 & \frac{Y_{Offset}}{Y_{Reference}} & 0 \\ 0 & 0 & \frac{Z_{Offset}}{Z_{Reference}} \end{pmatrix}; \text{and}$$

$$M_C = \begin{pmatrix} R_X & R_Y & R_Z \\ G_X & G_Y & G_Z \\ B_X & B_Y & B_Z \end{pmatrix} * M_T * \begin{pmatrix} R_X & R_Y & R_Z \\ G_X & G_Y & G_Z \\ B_X & B_Y & B_Z \end{pmatrix}^{-1};$$

wherein $(X\ Y\ Z)_{Reference}$ represents the transformation coordinate of the reference color block, $(X\ Y\ Z)_{Offset}$ represents the transformation coordinate of the target offset color block, $M_T$ represents a coordinate transformation matrix, $$\begin{pmatrix} R_X & R_Y & R_Z \\ G_X & G_Y & G_Z \\ B_X & B_Y & B_Z \end{pmatrix}$$

represents the RGB tristimulus matrix, and $M_C$ represents the color transformation matrix.

15. The display device according to claim 13, wherein the processing unit obtains RGB grayscale values of each offset color block according to the color coordinate of said offset color block, the RGB tristimulus matrix, and a gamma value of the color space.

16. The display device according to claim 1, wherein the adjusting interface comprises a brightness adjusting template.

17. A color adjusting method adapted to a display device, the color adjusting method comprising steps of:

the display device storing a color parameter under a color space;

the display device displaying an adjusting interface, wherein the adjusting interface comprises a reference color block and a plurality of offset color blocks, color coordinates of the offset color blocks are determined by a color coordinate of the reference color block and an offset value sequence, and the offset value sequence comprises a plurality of offset values;

when one of the offset color blocks is selected as a target offset color block, the processing unit updating the color coordinate of the reference color block by the color coordinate of the target offset color block, and updating the color coordinate of each of the offset color blocks by the color coordinate of the updated reference color block and one of the offset values;

the processing unit obtaining a color transformation matrix according to the color coordinate of the reference color block, the color coordinate of the target offset color block, and the color parameter; and the processing unit adjusting three output percentages of RGB by the color transformation matrix.

18. The color adjusting method according to claim 17, wherein the target offset color block is selected multiple times so that the reference color block approaches a target color, and the offset value used to update the color coordinate of each offset color block gradually decreases each time.

19. The color adjusting method according to claim 18, wherein the target color is provided by another display device or a color sheet.

20. The color adjusting method according to claim 17, wherein the processing unit obtains a transformation coordinate of the reference color block according to the color coordinate of the reference color block, and obtains a transformation coordinate of the target offset color block according to the color coordinate of the target offset color block, and the color transformation matrix is obtained by the following equations of:

$$(X \quad Y \quad Z)_{Offset} = (X \quad Y \quad Z)_{Reference} * M_T. ;$$

$$M_T = \begin{pmatrix} \frac{X_{Offset}}{X_{Reference}} & 0 & 0 \\ 0 & \frac{Y_{Offset}}{Y_{Reference}} & 0 \\ 0 & 0 & \frac{Z_{Offset}}{Z_{Reference}} \end{pmatrix}; \text{ and}$$

$$M_C = \begin{pmatrix} R_X & R_Y & R_Z \\ G_X & G_Y & G_Z \\ B_X & B_Y & B_Z \end{pmatrix} * M_T * \begin{pmatrix} R_X & R_Y & R_Z \\ G_X & G_Y & G_Z \\ B_X & B_Y & B_Z \end{pmatrix}^{-1};$$

wherein $(X\ Y\ Z)_{Reference}$ represents the transformation coordinate of the reference color block, $(X\ Y\ Z)_{Offset}$ represents the transformation coordinate of the target offset color block, $M_T$ represents a coordinate transformation matrix, $$\begin{pmatrix} R_X & R_Y & R_Z \\ G_X & G_Y & G_Z \\ B_X & B_Y & B_Z \end{pmatrix}$$

represents the RGB tristimulus matrix, and $M_C$ represents the color transformation matrix.

* * * * *